US008931165B2

(12) United States Patent
Kurosawa et al.

(10) Patent No.: US 8,931,165 B2
(45) Date of Patent: Jan. 13, 2015

(54) METHOD OF MANUFACTURING COIL DEVICE

(71) Applicant: Fujitsu Limited, Kawasaki-shi, Kanagawa (JP)

(72) Inventors: Hiroshi Kurosawa, Kawasaki (JP); Masayuki Itoh, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 294 days.

(21) Appl. No.: 13/626,091

(22) Filed: Sep. 25, 2012

(65) Prior Publication Data

US 2013/0118003 A1 May 16, 2013

(30) Foreign Application Priority Data

Nov. 16, 2011 (JP) ..... 2011-251128

(51) Int. Cl.
*H01F 7/06* (2006.01)
*H01F 41/06* (2006.01)
*H01F 41/12* (2006.01)

(52) U.S. Cl.
CPC ..... *H01F 41/06* (2013.01); *H01F 41/122* (2013.01)
USPC ..... 29/606; 29/605; 29/607; 336/65; 336/83; 336/90; 336/200; 336/206

(58) Field of Classification Search
USPC ..... 29/605–607; 336/65, 83, 90–96, 200, 336/206–208, 323
See application file for complete search history.

(56) References Cited

U.S. PATENT DOCUMENTS

| | | | | | |
|---|---|---|---|---|---|
| 4,889,601 | A * | 12/1989 | Arai | 205/227 |
| 5,477,204 | A * | 12/1995 | Li | 336/200 |
| 5,682,899 | A * | 11/1997 | Nashef et al. | 600/505 |
| 6,141,860 | A * | 11/2000 | Shimahara | 29/605 |
| 6,265,691 | B1 * | 7/2001 | Cardineau et al. | 219/121.69 |
| 6,413,651 | B1 * | 7/2002 | Yan et al. | 428/592 |
| 6,940,385 | B2 * | 9/2005 | Kusano | 336/200 |
| 8,400,251 | B2 * | 3/2013 | Banno et al. | 336/232 |
| 8,610,530 | B2 * | 12/2013 | Singh et al. | 336/200 |
| 2010/0079232 | A1 | 4/2010 | Okawa et al. | |

FOREIGN PATENT DOCUMENTS

| | | | | |
|---|---|---|---|---|
| JP | 60189915 | A * | 9/1985 | H01F 41/02 |
| JP | 03136220 | A * | 6/1991 | H01F 41/12 |
| JP | 06120063 | | 4/1994 | |
| JP | 06276706 | | 9/1994 | |
| JP | 06334507 | A * | 12/1994 | H03K 17/95 |
| JP | 09045470 | A * | 2/1997 | H05B 6/12 |
| JP | 09219324 | | 8/1997 | |
| JP | 09219326 | | 8/1997 | |
| JP | 10308315 | | 11/1998 | |
| JP | 2000260618 | | 9/2000 | |
| JP | 2008186848 | | 8/2008 | |
| JP | 2010273129 | A * | 12/2010 | |

* cited by examiner

*Primary Examiner* — Paul D Kim
(74) *Attorney, Agent, or Firm* — Squire Patton Boggs (US LLP)

(57) ABSTRACT

A method of manufacturing a coil device includes inserting planar insulating sheets into a single conductor formed in a solenoidal coil shape from a direction intersecting with a winding axis direction.

8 Claims, 7 Drawing Sheets

METHOD OF MANUFACTURING COIL DEVICE

CROSS-REFERENCE TO RELATED APPLICATION(S)

This application is based upon and claims the benefit of priority of the prior Japanese Patent Application No. 2011-251128, filed on Nov. 16, 2011, the entire contents of which are incorporated herein by reference.

FIELD

The embodiment discussed herein is related to a coil device.

BACKGROUND

A solenoidal coil-shaped conductor is covered with an insulator such as polyurethane. A coil-shaped conductor is formed by winding a conductor together with a tubular insulator such that the tubular insulator is placed between turns of the conductor.

Sheets of conductor and sheets of insulator are disposed alternately.

Related arts are disclosed in Japanese Laid-open Patent Publication Nos. 10-308315, 06-276706, 06-120063, 09-219326, 09-219324, 2008-186848, or 2000-260618.

SUMMARY

According to one aspect of the embodiments, a method of manufacturing a coil device includes inserting planar insulating sheets into a single conductor formed in a solenoidal coil shape from a direction intersecting with a winding axis direction.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

When a conductor, for example, a copper wire is processed into a coil shape, the covering may be damaged and insulation deterioration may occur owing to the occurrence of pinholes or the like. When the conductor is encased in magnetic powder, the covering may be damaged.

It may be difficult to accurately process the tubular insulator and the conductor that have different hardness or that include different materials.

Sheets of conductor coupled to each other may have a small current capacity and low DC superimposition characteristics compared to a single conductor having a solenoidal coil shape.

Figure 1:
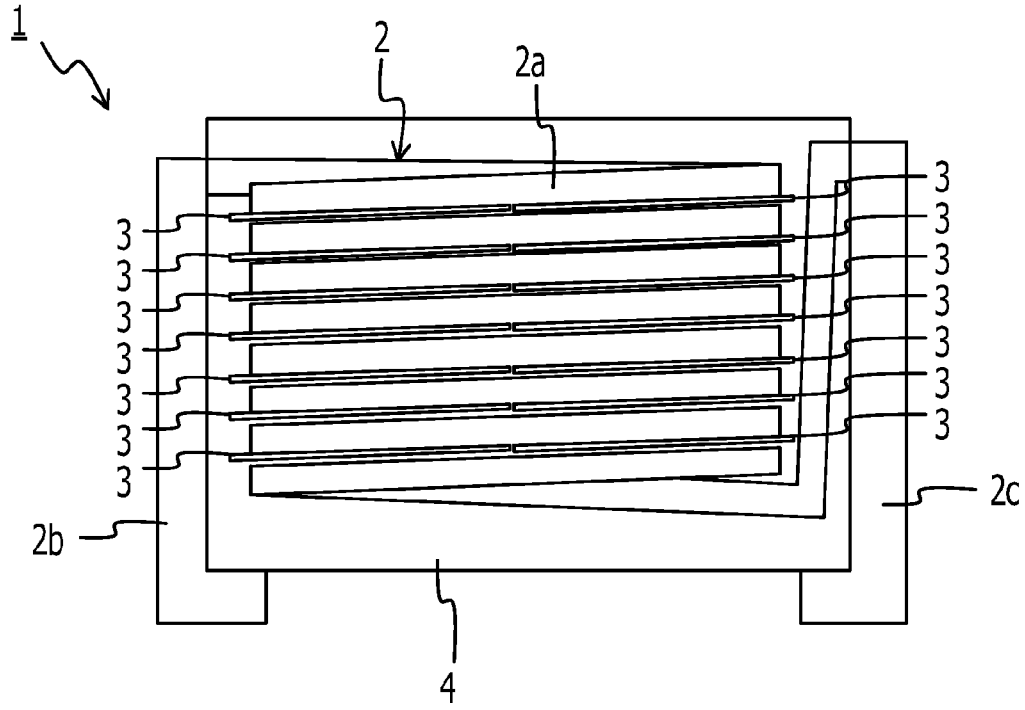
FIG. 1 illustrates an exemplary coil device.

FIG. 1 illustrates an exemplary coil device. The coil device 1 illustrated in FIG. 1 includes a conductor 2 that corresponds to a copper wire, insulating sheets (for example, insulating films) 3, and a magnetic body 4.

The conductor 2 may be, for example, a flat type copper wire. The conductor 2 includes a portion 2*a* formed in a solenoidal coil shape, and extending portions 2*b* and 2*c* extending downward from both ends of the portion 2*a* along the outer periphery of the magnetic body 4 that is formed, for example, in a cylindrical shape.

Of the extending portions 2*b* and 2*c*, the extending portion 2*b* on the left side of FIG. 1 protrudes from the outer periphery of the magnetic body 4 at the upper end of the solenoidal coil-shaped portion 2*a* and extends along the outer periphery of the magnetic body 4 to the bottom of the coil device 1.

Of the extending portions 2*b* and 2*c*, the extending portion 2*c* on the right side of FIG. 1 is bent upward at the lower end of the solenoidal coil-shaped portion 2*a*, then protrudes from the outer periphery of the magnetic body 4, and extends along the outer periphery of the magnetic body 4 to the bottom of the coil device 1.

The insulating sheets 3 are inserted into the gaps of the solenoidal coil-shaped portion 2*a* of the conductor 2. By the insulating sheets 3, A contact of portions of the solenoidal coil-shaped portion 2*a* that are provided adjacent in the winding axis A direction may be reduced.

Figure 2:
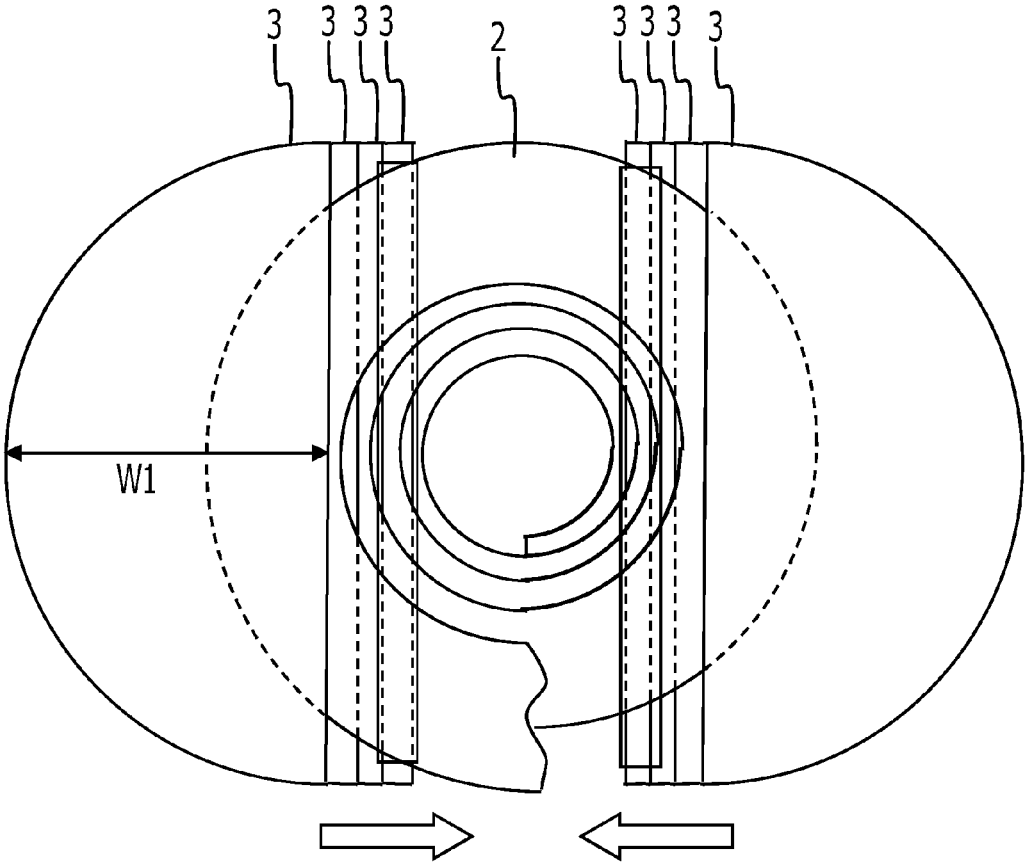
FIG. 2 illustrates an exemplary insulating sheet.
Figure 3:
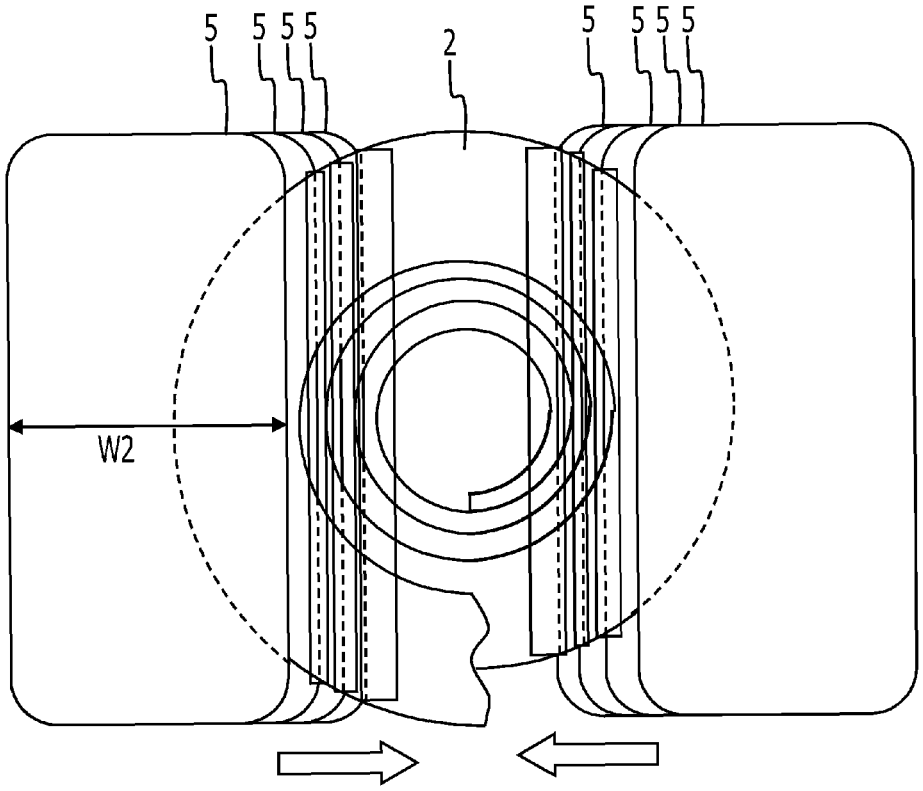
FIG. 3 illustrates an exemplary insulating sheet.

FIG. 2 and FIG. 3 each illustrate an exemplary insulating sheet. The insulating sheets 3 may have, for example, a semicircular shape as illustrated in FIG. 2, a rectangular shape, for example, a rectangular shape having rounded corners like the insulating sheets 5 illustrated in FIG. 3, or another shape. The insulating sheets 3 may fail to have a strictly semicircular shape and may have an approximately semicircular shape close to a semicircular shape, for example, a semi-hexagonal shape obtained by bisecting a regular hexagon with a straight line passing through two opposite vertices, or a shape obtained by bisecting a polygon having seven or more sides.

The insulating sheets 3 may have a circular shape, for example, a circular shape having a diameter greater than that of the conductor 2. In order to avoid interference with the conductor 2, the insulating sheets 3 may have a shape such as a semicircular shape and may be inserted from both sides along the winding axis A.

The thickness of the insulating sheets 3 may be, for example, 50 μm. The insulating sheets may have insulation property and workability comparable to an insulator 30 μm thick covering the conductor 2 itself and made of, for example, polyurethane or the same material as the insulating sheets 3. In places where the portions of the conductor 2 are adjacent to each other, the thickness of insulator is set to about 60 μm when the above insulator is used, whereas the thickness of the insulating sheets 3 is set to a value smaller than the thickness of insulator, for example 60 μm. For this reason, the thickness of the coil device 1 may be reduced.

Materials of the insulating sheets 3 may include fluororesin (Teflon (registered trademark)) and carbon. Of fluororesins, for example, PFA (tetrafluoroethylene perfluoroalkyl vinyl ether copolymer) or PTFE (polytetrafluoroethylene) has a heat resistance of temperature 260° C.

When the insulating sheets 3 are inserted into the conductor 2, due to the heat resistance of temperature 260° C. of the insulating sheets 3, the insulating sheets 3 may withstand the temperature when magnetic powder is hardened to form the magnetic body 4 or the reflow temperature, for example, 245° C., that is the usage environment when the coil device 1 is mounted on a wiring board. The heatproof temperature of the insulating sheets 3 may be higher than the formation temperature of the magnetic body 4 and the actual usage environmental temperature of the coil device 1. Polyurethane that may be used as a material of covering of a copper wire has a heatproof temperature of about 155° C. and a melting point of about 200° C., and thus the covered copper wire may fail to sufficiently withstand the formation temperature of the magnetic body 4 and the actual usage environmental temperature of the coil device 1.

As for NITOFLON No. 900UL, which is a fluororesin product, a film of polytetrafluoroethylene (PTFE) has a melting point of 327° C. and characteristic such as heat resistance, chemical resistance, electric property, low friction coefficient, and non-adherence. For this reason, when the insulating sheets 3 are formed of such a material, the thin insulating sheets 3 may have sufficient insulation property and workability.

The magnetic body 4 is formed, for example, into a cylindrical shape so as to cover the solenoidal coil-shaped portion 2*a* of the conductor 2 and the insulating sheets 3. The magnetic body 4 formed by hardening magnetic powder has insulation property.

Figure 4A:
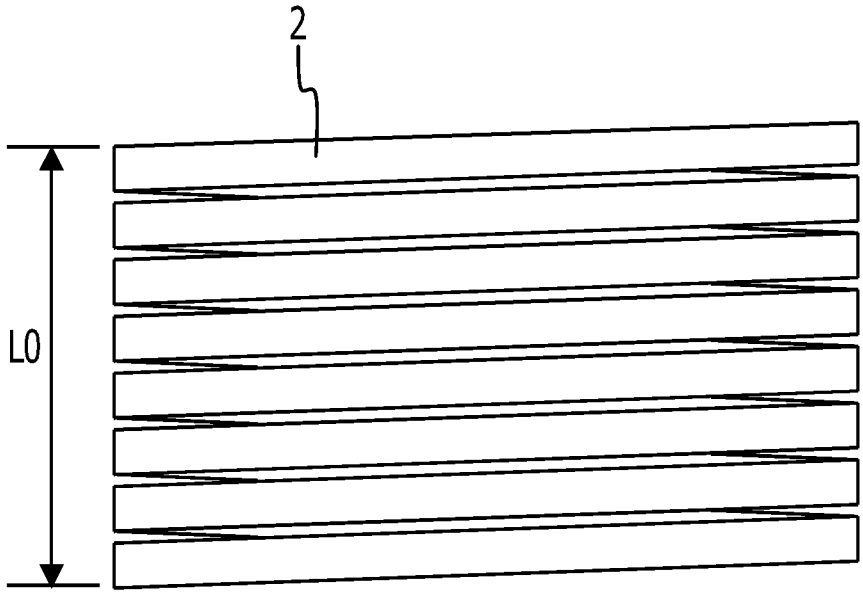
FIG. 4A to FIG. 4D illustrate an exemplary method for manufacturing a coil device.

FIG. 4A to FIG. 4D illustrate an exemplary method of manufacturing a coil device. As illustrated in FIG. 4A, a conductor 2 is processed into a solenoidal coil shape. At this stage, the conductor 2 is not covered with an insulator such as polyurethane, and insulating is not performed. The conductor 2 illustrated in FIG. 4A may be in a free state (length L0).

Figure 4B:
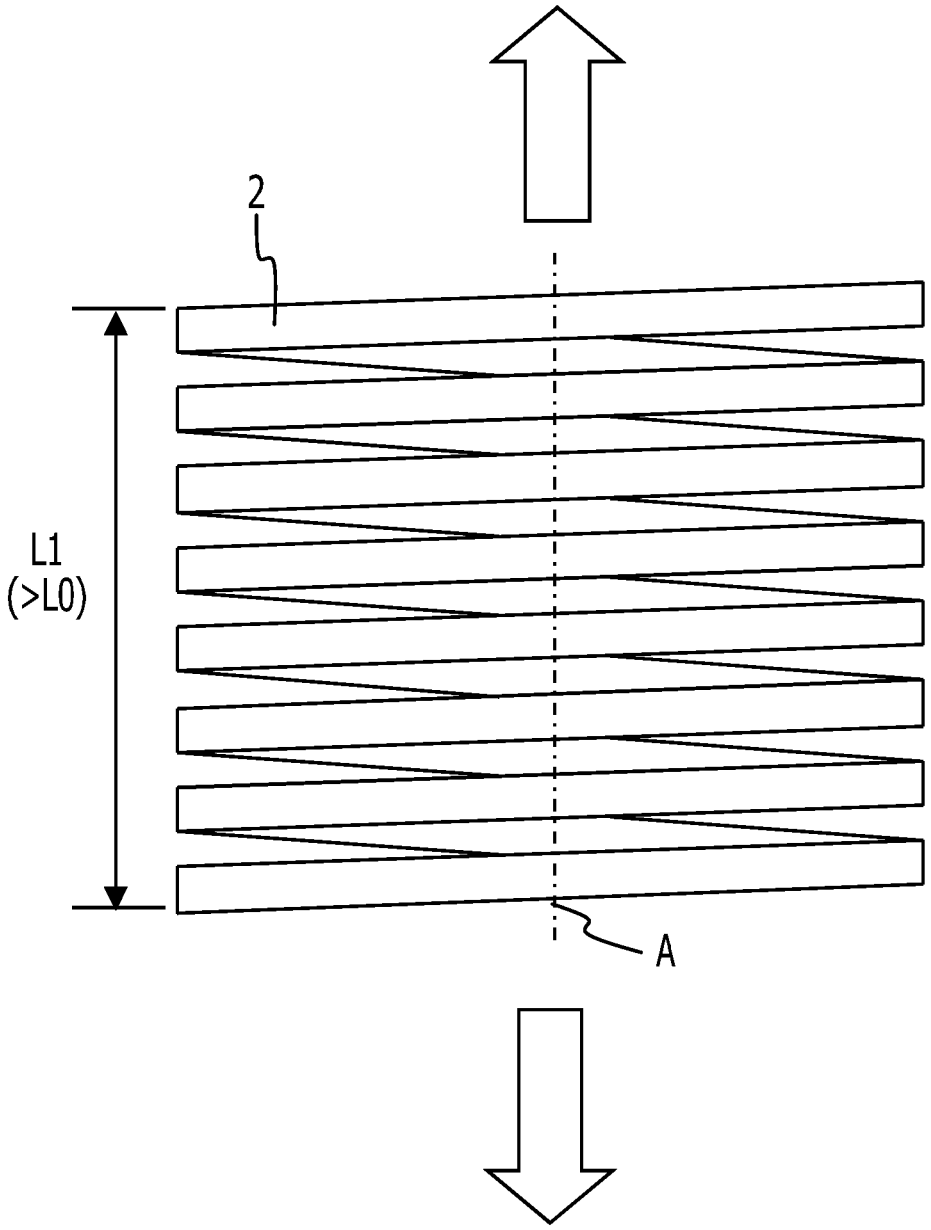
Figure 4C:
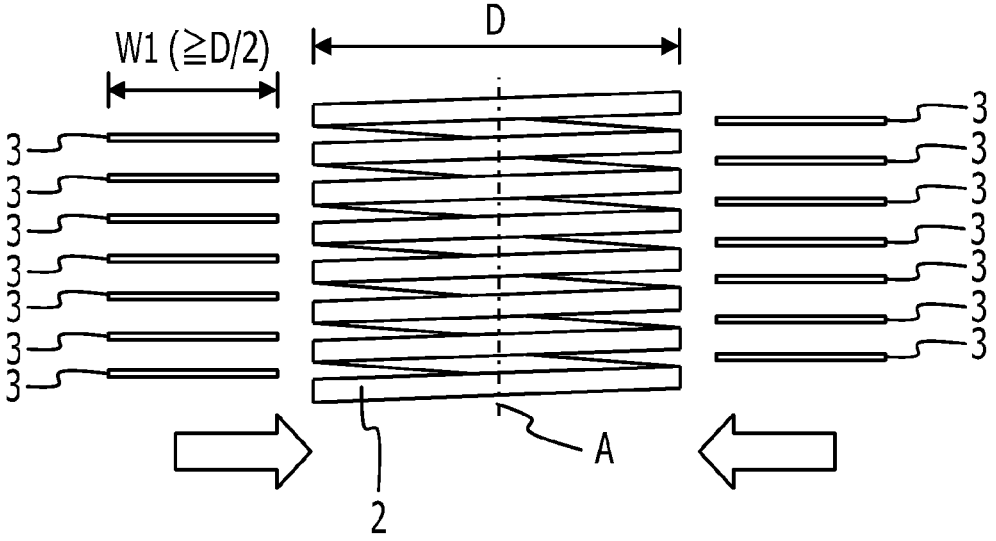

As illustrated in FIG. 4B, both the upper and lower ends of the conductor 2 processed into a solenoidal coil shape are held by a tension unit (not illustrated), and the conductor 2 is stretched in the winding axis A direction. The length L1 of the stretched conductor 2 may be greater than the length L0 in the free state illustrated in FIG. 4A.

As illustrated in 4C, insulating sheets 3 are inserted into gaps of the conductor 2 in a stretched state from a direction intersecting with the winding axis A direction. The insulating sheets 3 may be inserted into the conductor 2 from both sides along the winding axis A of the conductor 2 (from the right side and left side of FIG. 4C). All of the insulating sheets 3 on at least one of the both sides along the winding axis A, for example, all of the insulating sheets 3 on the right side of FIG. 4C or all of the insulating sheets 3 on the left side of FIG. 4C may be inserted into the conductor 2 contemporaneously. All of the insulating sheets 3 on both sides may be inserted contemporaneously.

When the insulating sheets 3 have a semicircular shape, the insulating sheets 3 may be inserted into the conductor 2 such that the straight-line portion of the semicircle approaches the winding axis A of the conductor 2. The width of the insulating sheets 3, for example, the radius W1 corresponding to the width in the diameter direction of the conductor 2 may be greater than or equal to the radius (D/2) of the conductor 2. As illustrated in FIG. 3, when the insulating sheets 5 have a rectangular shape, the width W2 in the diameter direction of the conductor 2 may be greater than or equal to the radius (D/2) of the conductor 2.

Figure 4D:
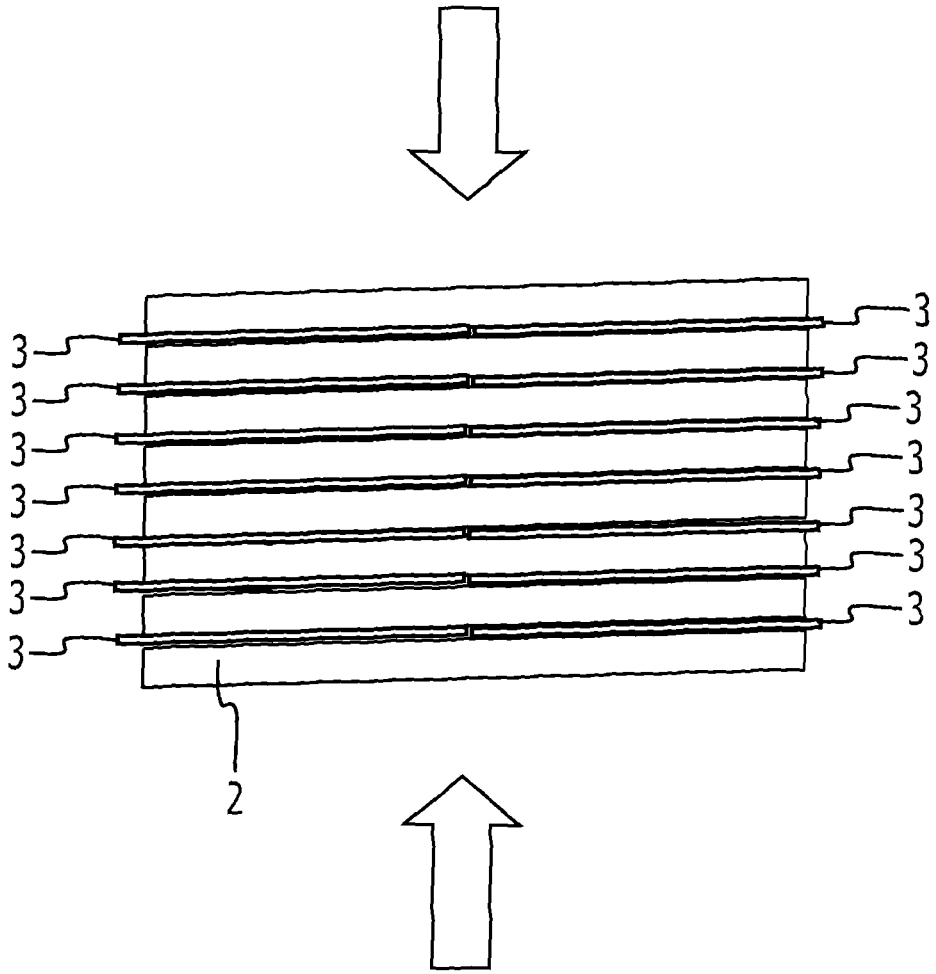

As illustrated in FIG. 4D, the conductor 2 into which the insulating sheets 3 are inserted is released from the stretched state and returns to the free state. If the gaps of the conductor 2 in the free state (the gaps in the winding axis A direction) is smaller than the thickness of the insulating sheets 3, the insulating sheets 3 are held between turns of the conductor 2.

Magnetic powder is hardened into a cylindrical shape and a magnetic body 4 is formed so as to cover the solenoidal coil-shaped portion 2*a* of the conductor 2 illustrated in FIG. 1 that may correspond to at least part of the conductor 2, and the whole of each of the insulating sheets 3 that may correspond to at least part of each of the insulating sheets 3.

Planar insulating sheets 3 or 5 may be inserted into a single conductor 2 formed in a solenoidal coil shape from a direction intersecting with the winding axis A direction. For this reason, when the conductor 2 is processed into a solenoidal coil shape, the insulating sheets 3 or 5 are not disposed, and thus the damage to the insulating sheets 3 during the processing of the conductor 2 may be reduced. After the conductor 2 is processed into a solenoidal coil shape, the insulating sheets 3 or 5 are disposed, and thus the processing of the conductor 2 may become easy.

The deterioration of insulator (insulating sheets 3) during the manufacturing of the coil device 1 may be reduced, and manufacturing may be facilitated. A single conductor 2 having a solenoidal coil shape may have a large current capacity and good DC superimposition characteristics compared to sheets of conductor.

The insulating sheets 3 or 5 are inserted from both sides along the winding axis A of the conductor 2. For this reason, the insulating sheets 3 or 5 may be reliably inserted into the gaps of the conductor 2.

All of the insulating sheets 3 or 5 on at least one of the both sides along the winding axis A are inserted into the conductor 2 contemporaneously. For this reason, manufacturing time may be shortened.

After the conductor 2 is stretched in the winding axis A direction and the insulating sheets 3 or 5 are inserted into the conductor 2 in a stretched state, the conductor 2 is released from the stretched state. For this reason, the insulating sheets 3 or 5 may be reliably inserted into the gaps of the conductor 2.

The insulating sheets 3 have a semicircular or approximately semicircular shape having a radius W1 greater than or equal to the radius (D/2) of the conductor 2. For this reason, the insulating sheets 3 or 5 may be reliably inserted into the gaps of the conductor 2.

After the insulating sheets 3 or 5 are inserted into the conductor 2, at least part of the conductor 2, for example, the solenoidal coil-shaped portion 2*a* is covered with a magnetic body 4. For this reason, the insulation by the insulating sheets 3 may be improved.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A method of providing a plurality of planar insulating sheets; and inserting the planar insulating sheets into gaps of a single conductor formed in a solenoidal coil shape, wherein the planar insulating sheets are inserted in a direction intersecting with a direction of a winding axis of the conductor.

2. The method according to claim 1, wherein the insulating sheets are inserted from opposite sides along the winding axis of the conductor.

3. The method according to claim 2, wherein all of the insulating sheets on at least one of the opposite sides along the winding axis are inserted into the conductor contemporaneously.

4. The method according to claim 1, further comprising:

stretching the conductor in the winding axis direction;

inserting the insulating sheets into the gaps of the conductor in a stretched state; and releasing the conductor from the stretched state.

5. The method according to claim 1, wherein the insulating sheets have a semicircular or approximately semicircular shape having a radius greater than or equal to a radius of the conductor.

6. The method according to claim 1, further comprising, covering at least part of the conductor and at least part of the insulating sheets with a magnetic body.

7. The method according to claim 1, wherein, when the insulating sheets have a semicircular shape, the insulating sheets are inserted into the gaps of the conductor such that a straight-line portion of the semicircular shape of the insulating sheets approaches the winding axis of the conductor.

8. The method according to claim 1, wherein a width of the insulating sheets is greater than or equal to a radius of the conductor.

* * * * *